US008072322B1

(12) United States Patent
Howard

(10) Patent No.: US 8,072,322 B1
(45) Date of Patent: Dec. 6, 2011

(54) INTERPRETING DATA FROM A SITE

(75) Inventor: Michael L. Howard, Renton, WA (US)

(73) Assignee: Control4 Corporation, Salt Lake City, UT (US)

( * ) Notice: Subject to any disclaimer, the term of this patent is extended or adjusted under 35 U.S.C. 154(b) by 1075 days.

(21) Appl. No.: 11/669,062

(22) Filed: Jan. 30, 2007

(51) Int. Cl.
*G08B 23/00* (2006.01)

(52) U.S. Cl. ..... 340/506; 340/504; 340/539.1

(58) Field of Classification Search ..... 340/539.1, 340/539.13, 539.18, 539.19, 539.25, 506, 340/601, 504; 455/456.1, 456.3, 404.2; 701/36, 701/201, 213; 342/457
See application file for complete search history.

(56) References Cited

U.S. PATENT DOCUMENTS 6,710,715 B2 * 3/2004 Deeds ..... 340/601
6,833,787 B1 * 12/2004 Levi ..... 340/539.13
6,847,892 B2 * 1/2005 Zhou et al. ..... 701/213
7,643,834 B2 * 1/2010 Ioppe et al. ..... 455/456.3
2002/0080938 A1 * 6/2002 Alexander et al. ..... 379/106.01
2005/0134450 A1 * 6/2005 Kovach ..... 340/506

OTHER PUBLICATIONS

"Amazon's Mechanical Turk," http://blog.outer-court.com/archive/2005-11-04-n69.html, pp. 1-2.
"CHI Image Sorting," http://blog.outer-court.com/archive/2005-03-28-n53.html, pp. 1-4.
"CHI, a Collaborative Human Interpreter," http://blog.outer-court.com/archive/2005-03-25-n43.html, pp. 1-5.
"Collaborative human interpreter," http://en.wikipedia.org/wiki/Collaborative_human_interpreter, May 2006.
"Mycroft—Technology Needs People," http://mycroftnetwork.com/, pp. 1-2, Accessed Sep. 1, 2006.

* cited by examiner

*Primary Examiner* — Van T. Trieu
(74) *Attorney, Agent, or Firm* — Austin Rapp & Hardman

(57) ABSTRACT

A method for interpreting data from a site is described. The method may include various steps. Input data to be interpreted may be acquired. The input data may be sent to an interpreter. Alert criteria may be sent to the interpreter. A determination that indicates whether the alert criteria was satisfied may be received. If the determination indicates that the alert criteria was satisfied, an alert procedure may be performed.

28 Claims, 13 Drawing Sheets

INTERPRETING DATA FROM A SITE

TECHNICAL FIELD

The present invention relates generally to computers and computer-related technology. More specifically, the present invention relates to interpreting data from a site.

BACKGROUND

The price of electronic devices has continued to decrease dramatically. In addition, the types of electronic components that can be purchased have continued to increase. For example, DVD players, large screen TVs, multi-carousel CD and DVD players, MP3 players, video game consoles, video cameras, security cameras, monitoring devices, and other electronic items have become more widely available while continuing to drop in price.

The decreasing prices and increasing types of electronic components has packed today's homes and businesses with modern conveniences. Yet as these conveniences grow in number and sophistication, they also become more difficult to manage and control. In recent years, automation systems have emerged to help manage and control the myriad devices found in modern buildings. Automation systems may allow a user to control nearly all of the electronic devices in the location.

With the affordability of new technology, the number of automated devices in buildings and at other locations has continued to steadily increase. Users now desire more customizable systems and features in their automation systems.

Additionally, there are an increasing number of image sensing applications. Some of these applications may include security system, home automation, health care, child care, and loss prevention applications.

One method for using image sensing systems is to establish a viewing station where a member of a security staff constantly monitors a set of video feeds and looks for intruders or suspicious behavior. The monitoring personnel may also be looking for environmental hazards such as smoke, flooding, or fire.

With the wide availability, reduced cost, and expanding use of video cameras, the number of conditions being monitored is also expanding. When used in assisted-care facilities, for example, the movement of patients during the night hours may be of interest. In home applications, the presence of a lone young child near a swimming pool might be cause for alarm.

Having a full-time employee watching video feeds may result in significant security costs. In some cases, these costs may be prohibitively expensive for many companies and/or individuals. One solution to this problem may include contracting with a security company to maintain constant surveillance for a set monthly fee. Although a monthly contract may be much less expensive than the hourly costs of a full-time employee, set monthly fees for continuous monitoring may still be prohibitive for some companies and/or individuals. Therefore, a need may exist for less expensive systems and methods for interpreting data from a site.

BRIEF DESCRIPTION OF THE DRAWINGS

Exemplary embodiments of the invention will become more fully apparent from the following description and appended claims, taken in conjunction with the accompanying drawings. Understanding that these drawings depict only exemplary embodiments and are, therefore, not to be considered limiting of the invention's scope, the exemplary embodiments of the invention will be described with additional specificity and detail through use of the accompanying drawings in which:

DETAILED DESCRIPTION

Figure 1:
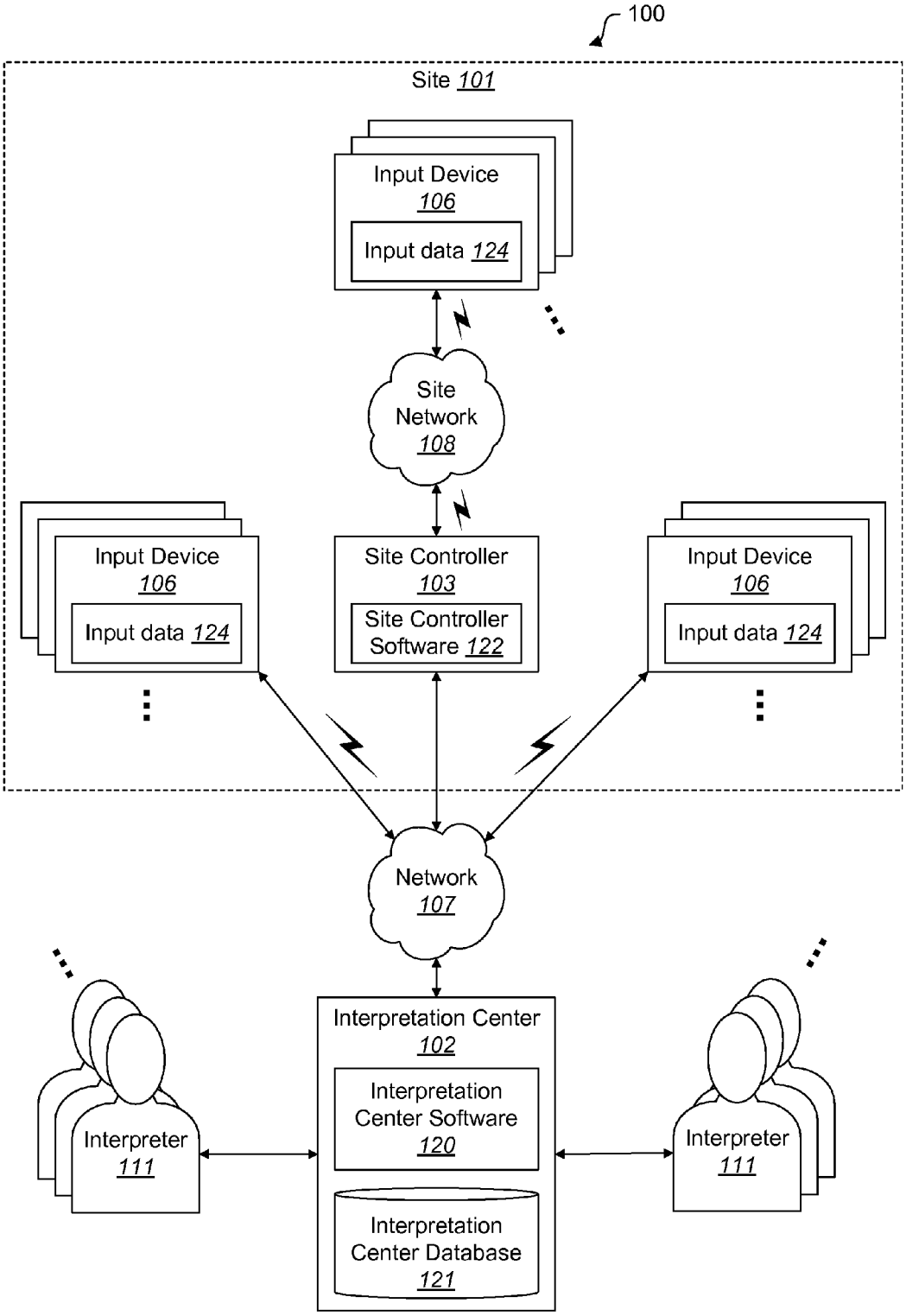
FIG. 1 is a block diagram illustrating a system for interpreting data from a site.

A method for interpreting data from a site is described. The method includes acquiring input data to be interpreted. The input data is sent to an interpreter. Alert criteria are sent to the interpreter. A determination is received that indicates whether the alert criteria was satisfied. If the determination indicates that the alert criteria was satisfied, an alert procedure is performed.

A system that is configured for interpreting data from a site is disclosed. The system includes a processor. The system also includes memory in electronic communication with the processor. Instructions are stored in the memory. The instructions are executable to acquire input data. The instructions are also executable to send the input data to an interpreter. The instructions are further executable to send alert criteria to the interpreter. The instructions are executable to receive a determination that indicates whether the alert criteria was satisfied. If the determination indicates that the alert criteria was satisfied, the instructions are executable to perform an alert procedure.

An interpretation center that is configured for interpreting data from a site is disclosed. The interpretation center is in electronic communication with a plurality of interpreters. The interpretation center includes a processor. The interpretation center also includes memory in electronic communication with the processor. Instructions are stored in the memory. The instructions are executable to register the interpreters with the interpretation center. The instructions are also executable to acquire input data that originated from an input device. The input device is in electronic communication with the interpretation center. The instructions are executable to send the input data to the interpreters. The instructions are also executable to send alert criteria to the interpreters. The instructions are further executable to receive a determination that indicates whether the alert criteria was satisfied from at least one of the interpreters. If the determination indicates that the alert criteria was satisfied, the instructions are executable to perform an alert procedure.

In some embodiments, the input data is acquired from an input device. In further embodiments, a visual image is provided to the interpreter.

In some embodiments, the alert criteria includes explicit criteria. In other embodiments, the alert criteria includes implicit criteria. In further embodiments, the alert criteria comprises a list. In other embodiments, the alert criteria comprises a list of statements. In some embodiments, the alert procedure initiates an alert. In other embodiments, the alert procedure cancels an alert.

In some embodiments, the determination that indicates whether the alert criteria was satisfied is stored. In other embodiments, it is determined to which interpreter to send the input data and the alert criteria. In further embodiments, it is determined whether a triggering event was detected.

In some embodiments, a site controller sends the input data to the interpreter. In further embodiments, a visual image is provided to the interpreter.

In some embodiments, the site controller that receives the input data from the input device and sends the input data to the interpretation center. In further embodiments, the site controller is an embedded system that includes built-in audio ports, built-in video ports, and built-in infrared in and out ports and wherein the site controller does not require an external exclusive computer monitor for standard operation.

Various embodiments of the invention are now described with reference to the Figures, where like reference numbers indicate identical or functionally similar elements. The embodiments of the present invention, as generally described and illustrated in the Figures herein, could be arranged and designed in a wide variety of different configurations. Thus, the following more detailed description of several exemplary embodiments of the present invention, as represented in the Figures, is not intended to limit the scope of the invention, as claimed, but is merely representative of the embodiments of the invention.

The word "exemplary" is used exclusively herein to mean "serving as an example, instance, or illustration." Any embodiment described herein as "exemplary" is not necessarily to be construed as preferred or advantageous over other embodiments.

Many features of the embodiments disclosed herein may be implemented as computer software, electronic hardware, or combinations of both. To clearly illustrate this interchangeability of hardware and software, various components will be described generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present invention.

Where the described functionality is implemented as computer software, such software may include any type of computer instruction or computer executable code located within a memory device and/or transmitted as electronic signals over a system bus or network. Software that implements the functionality associated with components described herein may comprise a single instruction, or many instructions, and may be distributed over several different code segments, among different programs, and across several memory devices.

As used herein, the terms "an embodiment," "embodiment," "embodiments," "the embodiment," "the embodiments," "one or more embodiments," "some embodiments," "certain embodiments," "one embodiment," "another embodiment" and the like mean "one or more (but not necessarily all) embodiments of the disclosed invention(s)," unless expressly specified otherwise.

The term "determining" (and grammatical variants thereof) is used in an extremely broad sense. The term "determining" encompasses a wide variety of actions and therefore "determining" can include calculating, computing, processing, deriving, investigating, looking up (e.g., looking up in a table, a database or another data structure), ascertaining and the like. Also, "determining" can include receiving (e.g., receiving information), accessing (e.g., accessing data in a memory) and the like. Also, "determining" can include resolving, selecting, choosing, establishing, and the like.

The phrase "based on" does not mean "based only on," unless expressly specified otherwise. In other words, the phrase "based on" describes both "based only on" and "based at least on."

FIG. 1 is a block diagram illustrating a system 100 for interpreting data from a site. The system 100 may include a site 101, a network 107, an interpretation center 102, and multiple interpreters 111.

The site 101 may include a site controller 103. The site controller 103 may include site controller software 122. The site controller software 122 may be used to control the input devices 106 in the site 101. The site controller software 122 may be used to send and/or receive data to and/or from the input devices 106. The site controller software 122 may be used to send and/or receive data to and/or from the interpretation center 102.

The system 100 may include multiple input devices 106. The input devices 106 may be used to detect and/or monitor situations at a site 101. The input devices 106 may include input data 124. The input devices 106 may send the input data 124 to the network 107. In some embodiments the input devices 106 may have a connection to a network outside of the control of the site controller 103. In other embodiments the input devices 106 may not have a connection to a network outside of the control of the site controller 103. For example, the input devices 106 may not be in direct electronic communication with the network 107; rather, the input devices 106 may connect to the network 107 through the site controller 103 via a site network 108.

The site controller 103 may be in electronic communication with the input devices 106. The input devices 106 may communicate with the site controller 103 over the site network 108. The site network 108 may be a wired or wireless network. For example, the input devices 106 may communicate with the site controller 103 via an infrared (IR) connection, an Ethernet connection, a wireless connection using the 802.11g (WiFi) standard, a wireless connection using the 802.15.4 (ZigBee) standard, or other wired or wireless connections.

The interpretation center 102 may be in electronic communication with the site 101 via the network 107. The network 107 may include a computer network. For example, the network 107 may operate using wired protocols, such as an Ethernet connection; wireless protocols, such as WiFi, ZigBee, Bluetooth, Ultra Wideband, Wimax; cellular protocols, such as GSM or EVDO; and/or any other protocol. In the present embodiment, the site controller 103 is in electronic communication with the interpretation center 102 via the network 107. The interpretation center 102 may include interpretation center software 120 and an interpretation center database 121. The interpreters 111 may use the interpretation center 102 to interpret input data 124 from the site 101. The interpretation center software 120 may be used to facilitate communication between the site controller 103 and the interpretation center 102. The interpretation center software 120 may also be used to determine to which interpreter 111 to send the input data 124.

Figure 2:
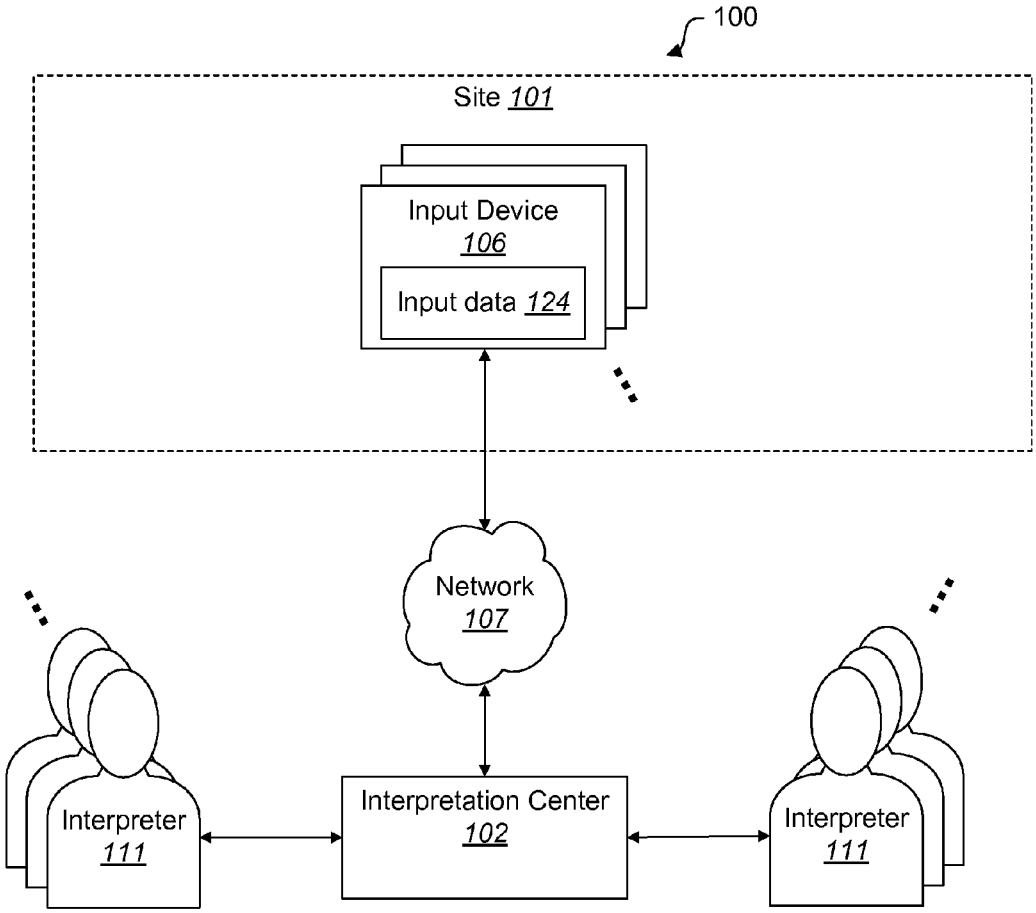
FIG. 2 is a block diagram illustrating another system for interpreting data from a site.

FIG. 2 is a block diagram illustrating a system 100 for interpreting data from a site. The system 100 may include a site 101, a network 107, an interpretation center 102, and multiple interpreters 111.

The site 101 may include multiple input devices 106. The input devices 106 may be used to detect and/or monitor situations at a site 101. The input devices 106 may include input data 124. The input devices 106 may send the input data 124 to the network 107.

The interpretation center 102 may be in electronic communication with the site 101 via the network 107. The network 107 may include a computer network. For example, the network 107 may operate using wired protocols, such as an Ethernet connection; wireless protocols, such as WiFi, ZigBee, Bluetooth, Ultra Wideband, Wimax; cellular protocols, such as GSM or EVDO; and/or any other protocol. In the present embodiment, the input devices 106 are in electronic communication with the interpretation center 102 via the network 107. The interpreters 111 may use the interpretation center 102 to interpret input data 124 from the site 101.

Figure 3:
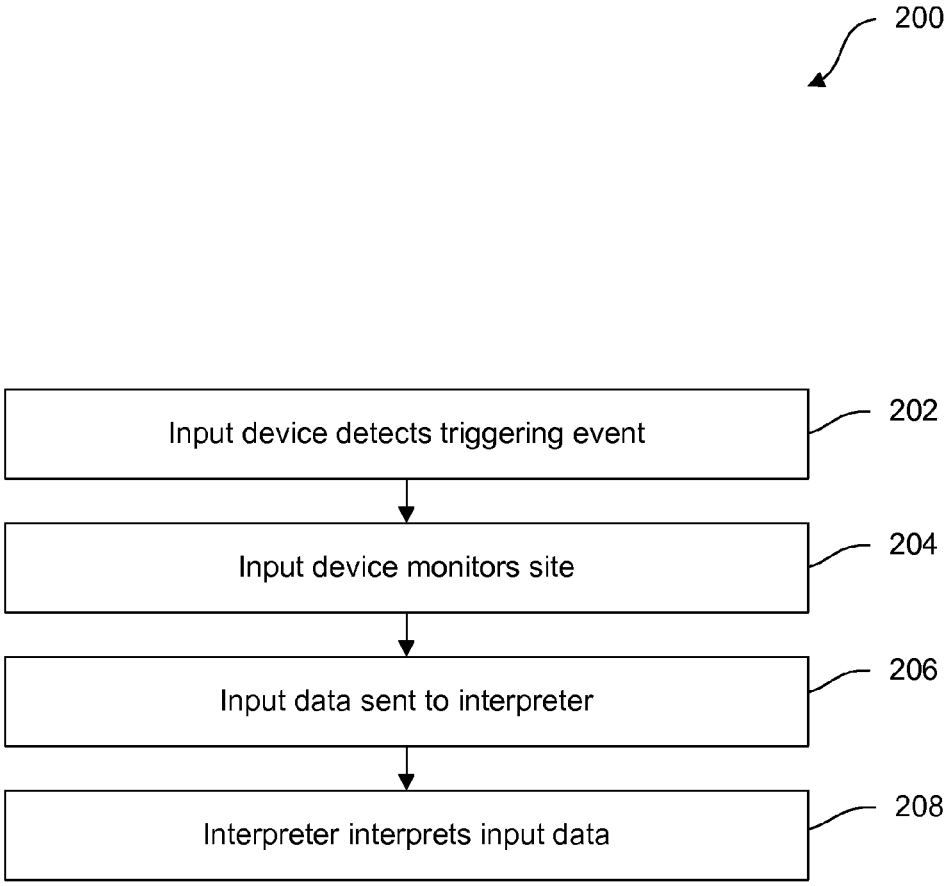
FIG. 3 is a flow diagram of an embodiment of a method for interpreting data from a site.

FIG. 3 is a flow diagram of an embodiment of a method 200 for interpreting data from a site 101. The method 200 may include an input device 106 detecting 202 a triggering event.

An input device 106 may monitor 204 the site 101. Monitoring 204 the site 101 may include generating input data 124. In some embodiments, the site 101 may be monitored 204 in response to a triggering event. In other embodiments, detecting 202 a triggering event may be omitted and an input device 106 may monitor 204 the site 101 periodically, continuously, and/or using other monitoring configurations.

Input data 124 may be sent 206 to the interpreter 111. The interpreter 111 may interpret 208 the input data 124. Interpreting 208 the input data 124 may include determining whether the input data 124 satisfies predetermined criteria. The interpreter 111 may include a human that may interpret input data 124.

Figure 4:
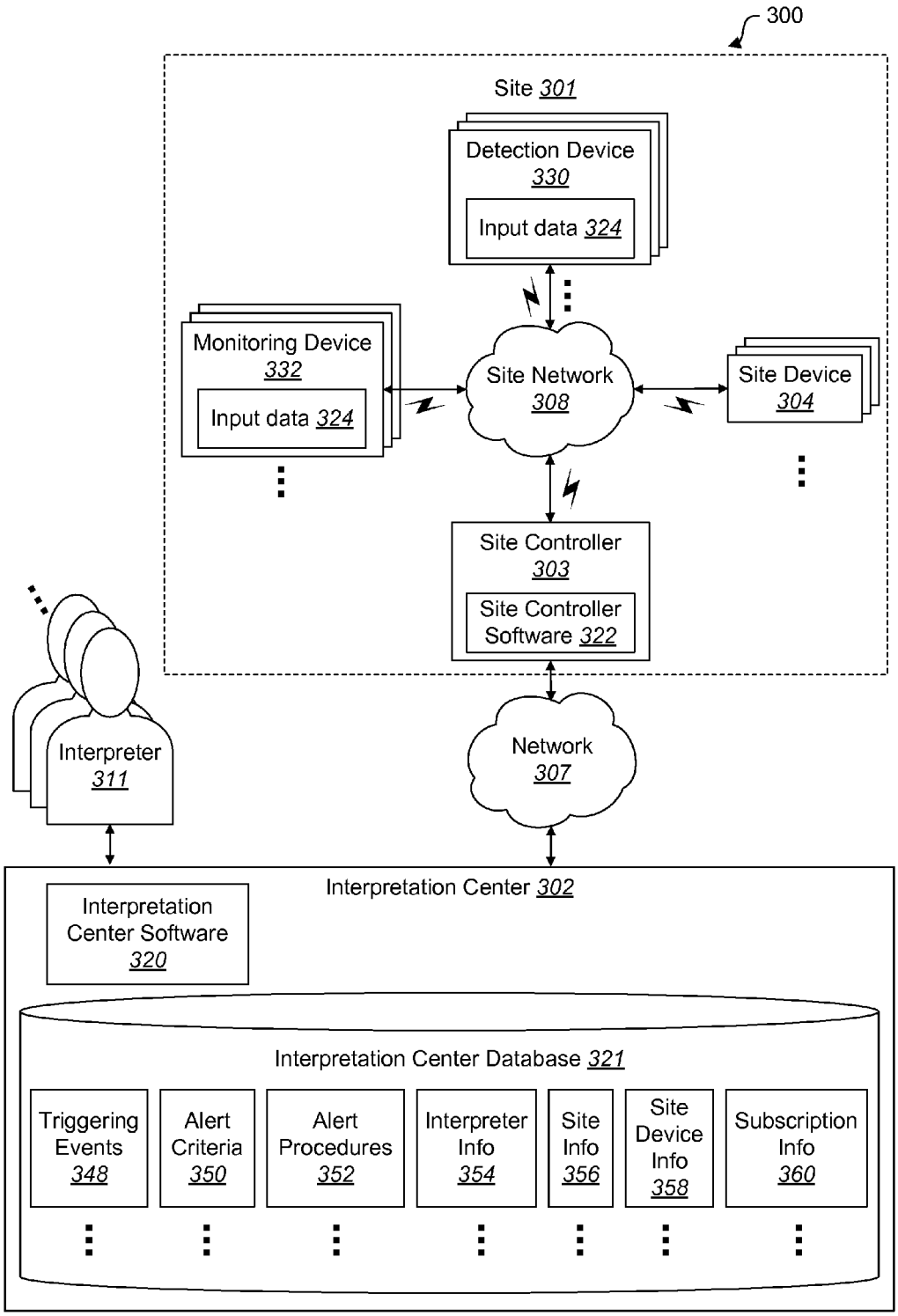
FIG. 4 is a block diagram illustrating a system for interpreting data from a site.

FIG. 4 is a block diagram illustrating a system 300 for interpreting data from a site 301. The system 300 may include a site 301, a network 307, an interpretation center 302, and multiple interpreters 311.

The site 301 may include a site controller 303. The site controller 303 may include site controller software 322. The system 300 may include multiple input devices 106. The input devices 106 may include detection devices 330 and/or monitoring devices 332. Detection devices 330 may be used to detect situations (i.e. alert criteria) at the site 301. Monitoring devices 332 may be used to monitor 204 a site 301.

An input device 106 may be both a detection device 330 and/or a monitoring device 332. For example, an input device 106 may be capable of both detecting and/or monitoring situations at a site 301.

The detection devices 330 and/or monitoring devices 332 may include input data 324. Input data 324 may include data from the input devices 106 such as sensor data, monitoring data, and/or other input data 324. The site 301 may also include various site devices 304.

The input devices 106 may send the input data 324 to the network 307. The site controller 303 may be in electronic communication with the input devices 106 and site devices 304. For the purposes of this disclosure, site devices 304 may include input devices 106, such as detection devices 330 and/or monitoring devices 332. The site devices 304 may communicate with the site controller 303 over the site network 308. The site network 308 may be a wired or wireless network. For example, the site devices 304 may communicate with the site controller 303 via an infrared (IR) connection, an Ethernet connection, a wireless connection using the 802.11g (WiFi) standard, a wireless connection using the 802.15.4 (ZigBee) standard, or other wired or wireless connections.

The interpretation center 302 may be in electronic communication with the site 301 via the network 307. The network 307 may operate using wired protocols, wireless protocols, cellular protocols, and/or any other protocol. In the present embodiment, the site controller 303 is in electronic communication with the interpretation center 302 via the network 307. The interpretation center 302 may include interpretation center software 320 and an interpretation center database 321.

The interpretation center database 321 may include triggering events 348, alert criteria 350, alert procedures 352, interpreter information 354, site information 356, site device information 358, and/or subscription information 360. Triggering events 348 may include events that may occur at a site 301. Triggering events 348 may be associated with the alert criteria 350 and/or the alert procedures 352. For example, a triggering event 348 may include a motion sensor detecting motion, an IR sensor detecting heat, a perimeter sensor detecting a breach of the perimeter, a smoke and/or carbon monoxide sensor detecting smoke and/or carbon monoxide, an audio sensor detecting sound, a temperature sensor detecting a change in temperature, a water level sensor detecting the level of water, etc.

The alert criteria 350 may include criteria that may be used by an interpreter 311 to determine whether to perform an alert procedure 352. The alert criteria 350 may include explicit and implicit criteria. Explicit criteria may be less subjective. For example, explicit criteria might include a statement such as "is the window broken?" Implicit criteria may be more subjective. For example, implicit criteria may include "is the area secure?" The alert criteria 350 may include multiple criteria, such as a list.

The alert procedures 352 may include information such as instructions for an interpreter 311 if the alert criteria 350 are satisfied. The alert criteria 350 may include a single statement that an interpreter 311 may determine is true or false. The alert criteria 350 may include a list of statements that an interpreter 311 may choose from to determine which is most accurate. For example, the alert criteria 350 may be a list of statements, such as does this person look (A) very suspicious, (B) somewhat suspicious, (C) not very suspicious, or (D) not suspicious, from which the interpreter 311 may select the most accurate statement.

Interpreter information 354 may include information about the interpreter 311. For example, the interpreter information 354 may include the contact information for the interpreter 311. Contact information may include the physical address, telephone number, email address, network address, and/or other contact information for the interpreter 311.

The site information 356 may include information about the site 301. For example, the site information 356 may include a prior interpretation history (i.e. data relating to prior site monitoring), various site zones, contact information for the site, the location of the site, and/or other information regarding the site 301. The contact information may include the site telephone number, name of the user, and/or other contact and user information.

Site device information 358 may include the types of site devices 304 at the site 301. The site device information 358 may include identifications, capabilities, locations, software versions, and other information for each site device 304. For example, the site device information 358 may include which site devices 304 are capable of detecting and/or monitoring the site 301.

The subscription information 360 may include information regarding a subscription for the site 301. For example, the user may have a subscription from the site 301. The subscription information 360 may include the duration of the subscription, the type of subscription, and/or other subscription information 360. The subscription information 360 may include the amounts of money that may be paid to an interpreter 311 for interpreting 208 input data 324. The subscription information 360 may include billing information. Billing information may include information used to bill a user for a subscription from a site 301. For example, billing information may include credit card information for the user, payment history for the user, and/or other billing information.

The interpreters 311 may use the interpretation center 302 to interpret input data 324 from the site 301. The interpretation center software 320 may be used to facilitate communication between the site controller 303 and the interpretation center 302. The interpretation center software 320 may be used to determine to which interpreter 311 to send the input data 324. The interpretation center software 320 may be used to determine other information in the interpretation center database 321. The interpretation center software 320 may be used to facilitate communication between the interpreter 311 and the interpretation center 302.

Figure 5:
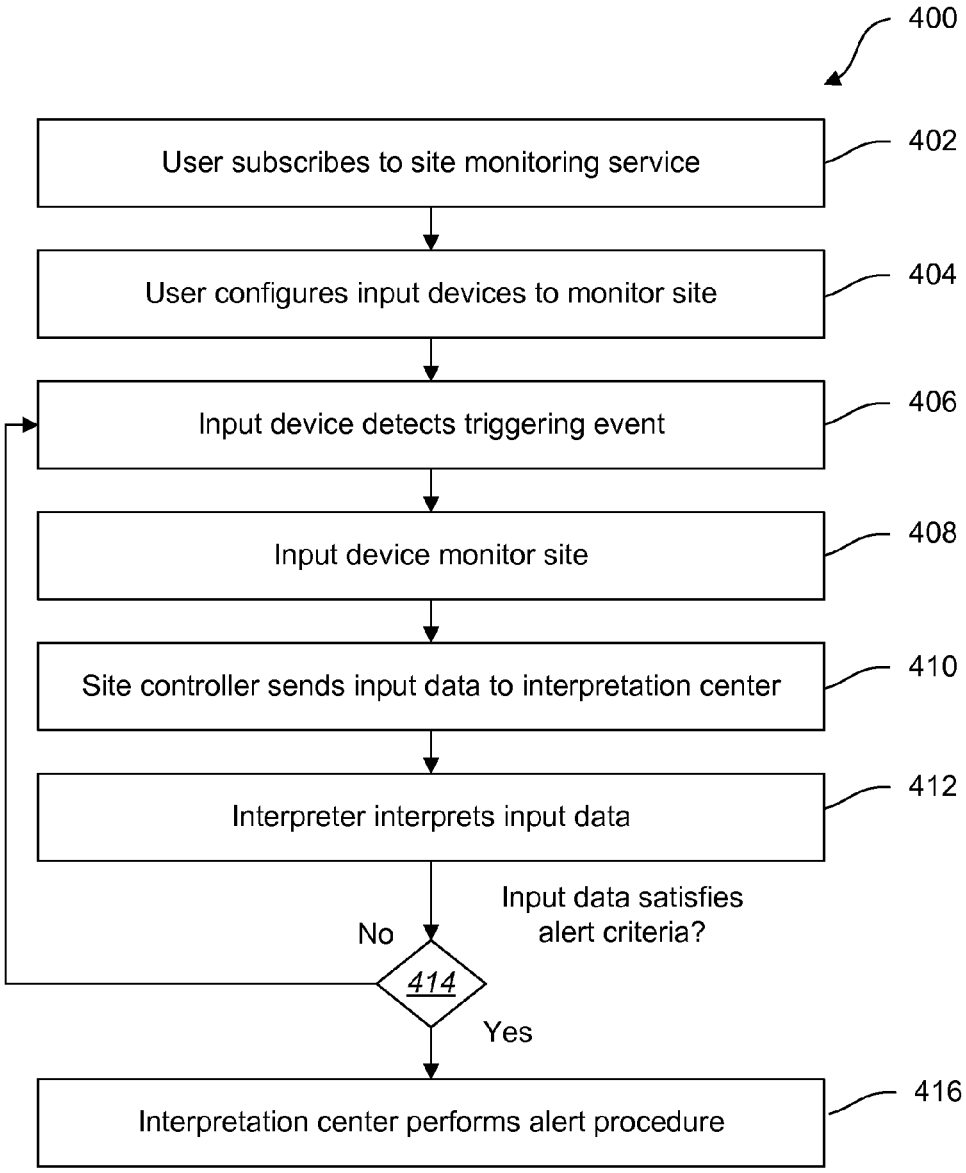
FIG. 5 is a flow diagram of an embodiment of a method for interpreting data from a site.

FIG. 5 is a flow diagram of an embodiment of a method 400 for interpreting data from a site 101. The method 400 may include a user subscribing 402 to a site monitoring service. A site monitoring service may include monitoring a site 101. Subscribing 402 to a site monitoring service may include creating an account with the site monitoring service. For example, the user may subscribe 402 to the site monitoring service over the Internet. The interpretation center 102 may store the subscription information 360 in the interpretation center database 321.

The user may configure 404 the input devices 106 to monitor the site 101. Configuring 404 the input devices 106 may include determining where to locate the input devices 106 in a site 101. Configuring 404 the input devices 106 may include connecting the input devices 106 to the interpretation center 102. For example, the input devices 106 may be configured 404 to connect directly to the interpretation center 102 and/or indirectly through a site controller 103. Configuring 404 the input devices 106 may include storing the triggering events 348, alert criteria 350, and/or alert procedures 352 on the input devices 106. Configuring 404 the input devices 106 may include storing the site information 356, site device information 358, and/or any other information in the interpretation center database 321.

For example, the input device 106 may be a detection device 330, such as a motion sensor. The motion sensor may be configured 404 with a triggering event 348. The triggering event 348 may occur when the motion sensor detects motion within an area of the site 101. The triggering event 348 may be based on the speed, direction, other aspects of the motion of an object, and/or customizable aspects of the triggering event 348. For example, the triggering event 348 may be determined such that small animals may not satisfy the triggering event 348.

The input device 106 may detect 406 a triggering event 348. For example, the motion sensor may detect 406 the movement of a person within a designated area of the site 101. When an input device 106 detects 406 a triggering event 348, the input device 106 may store the data associated with the detection 406 as input data 124. The input data 124 may be sent to the site controller 103.

The input device 106 may monitor 408 the site 101. In some embodiments, the input device 106 that detected 406 the triggering event 348 may be the same input device 106 that monitors 408 the site. In other embodiments, the input device 106 that detected 406 the triggering event 348 may be a different input device 106 than the input device 106 that monitors 408 the site. In some embodiments, the input device 106 that monitors 408 the site 101 may do so without a triggering event 348 being detected 406 (i.e. continuous, periodic, and/or other monitoring configurations).

For example, the input device 106 that monitors 408 the site 101 may be a camera. When the input device 106 detects 406 motion that satisfies the triggering event criteria, the input data 124 may be used to determine that an input device 106 should monitor 408 the site 101. For example, the camera may be instructed to monitor 408 the site 101. The input device 106 may monitor 408 the site 101 for a predetermined amount of time, may take a predetermined number of pictures, etc. The data generated by monitoring 408 the site 101 may include input data 124. For example, the pictures taken by the camera while monitoring 408 the site 101 may be input data 124.

The data, which may include input data 124, obtained during the detection 406 of a triggering event 348 and/or the monitoring 408 of the site 101, may be sent 410 to the interpretation center 102. In some embodiments, the input data 124 may be sent 410 directly from the site 101 to the interpreter 111. In other embodiments, the input data 124 may be sent 410 indirectly to the interpreter 111. For example, the input device 106 may send the input data 124 to the site controller 103, which may send the input data 124 to the interpretation center 102, which may send the input data 124 to the interpreter 111. In the present embodiment, the site controller 103 may receive the input data 124 from the input device 106 and may send 410 the input data 124 to the interpretation center 102.

An interpreter 111 may interpret 412 the input data 124. For example, the interpreter 111 may receive input data 124 obtained during the detection 406 of a triggering event 348 or the monitoring 408 of the site 101 and may interpret 412 the input data 124. Interpreting 412 the input data 124 may include looking at the input data 124. For example, the input data 124 may be a picture taken by an input device 106, such as a camera, while monitoring 408 the site 101.

The interpreter 111 may determine 414 whether the input data 124 satisfies the alert criteria 350. For example, the alert criteria 350 may include whether the input data 124 indicates that a person is in the picture taken by the camera. The interpreter 111 may interpret 412 the picture by looking at the picture and determining 414 if there is a person in the picture. The alert criteria 350 may include whether the person in the picture is authorized to be present at the site, such that the interpreter 111 may compare the picture taken by the camera with pictures of authorized persons that may be stored as site information 356 in the interpretation center database 321. The alert criteria 350 may also include whether the person in the picture looks suspicious.

Alert criteria 350 may be subjective. Typically, computing devices may have difficulty determining 414 alert criteria 350 that is subjective like, "does the person look suspicious?" In some embodiments, the interpretation center 102 may determine 414 whether the input data 124 satisfies the alert criteria 350.

If it is determined 414 that the input data 124 satisfies the alert criteria 350, the interpretation center 102 may perform 416 the alert procedure 352. For example, the interpreter 111 may indicate that the alert criteria 350 was satisfied, which may prompt the interpretation center 102 to perform 416 the alert procedure 352. The alert procedure 352 may include notifying the site 101 of an alert. For example, the interpretation center 102 may communicate to the site 101 that an unauthorized person has been detected. In some embodiments, the alert procedure 352 may be performed 416 by the interpreter 111 and/or the site controller 103. In further embodiments, the alert procedure 352 may include communicating that the alert criteria 350 have been satisfied to a third party, such as a security service, property management service, and/or other third party. In still further embodiments, the alert procedure 352 may include initiating and/or cancelling an alert.

If it is determined 414 that the input data 124 does not satisfy the alert criteria 350, the input devices 106 may continue monitoring the site 101 until the input devices 106 detect 406 a triggering event 348. The interpretation center 102 may store any information related to the triggering event 348, input data 124, interpretation 412, and/or other data as site information 356 in the interpretation center database 321. In some embodiments, the input device 106 may wait for a period of time before detecting 406 another triggering event 348.

Figure 6:
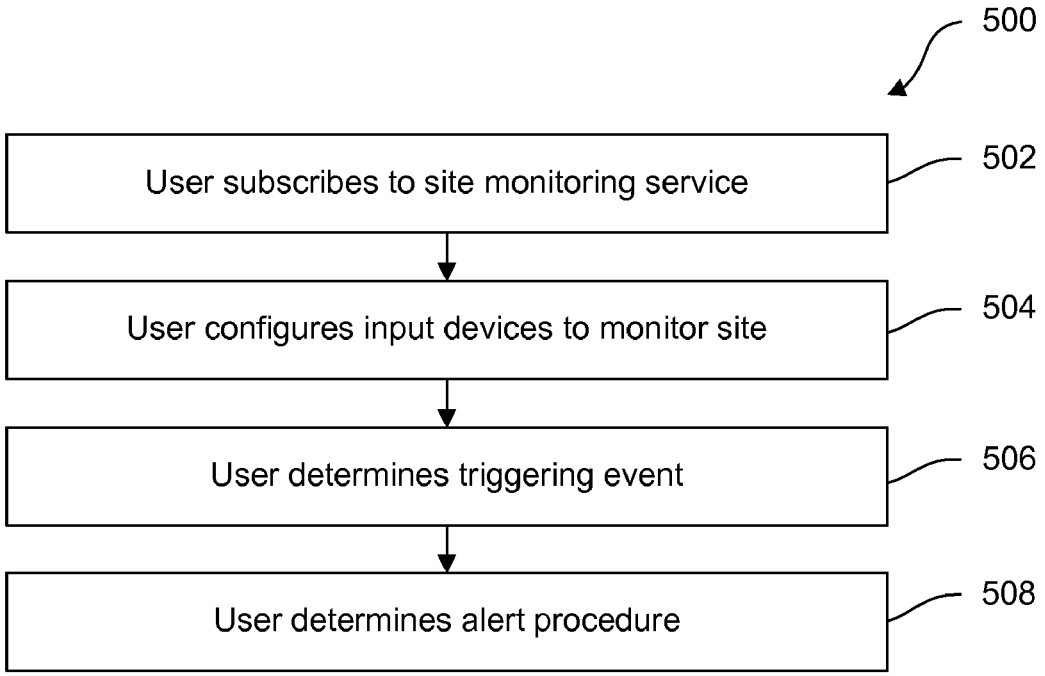
FIG. 6 is a flow diagram of an embodiment of a method for interpreting data from a site.

FIG. 6 is a flow diagram of an embodiment of a method 500 for interpreting data from a site 101. The method may include a user subscribing 502 to a site monitoring service. Subscribing 502 to a site monitoring service may include creating an account with the site monitoring service.

The user may configure 504 the various input devices 106 to monitor the site 101. Configuring 504 the input devices 106 may include registering the devices with a site controller 103. Configuring 504 the input devices 106 may include determining where to locate the input devices 106 in a site 101; connecting the input devices 106 to the interpretation center 102; storing the triggering events 348, alert criteria 350, and/or alert procedures 352 on the input devices 106; storing the site information 356, site device information 358, and/or any other information in the interpretation center database 321; and/or other configuration processes.

The user may determine 506 a triggering event 348. A triggering event 348 may include an event that may occur at a site 101. Triggering events 348 may be associated with the alert criteria 350 and/or the alert procedures 352. For example, a triggering event 348 may include a motion sensor detecting motion, an IR sensor detecting heat, a perimeter sensor detecting a breach of the perimeter, a smoke and/or carbon monoxide sensor detecting smoke and/or carbon monoxide, an audio sensor detecting sound, a temperature sensor detecting a change in temperature, a water level sensor detecting the level of water, etc. The triggering event 348 may be based on the speed, direction, other aspects of the motion of an object, and/or customizable aspects of the triggering event 348.

The user may determine 508 an alert procedure 352. An alert procedure 352 may include information such as instructions for an interpreter 111 if the alert criteria 350 are satisfied. The alert procedure 352 may include notifying the site 101 of an alert. For example, the interpretation center 102 may communicate to the site 101 that an unauthorized person has been detected. In some embodiments, the alert procedure may be performed 416 by the interpreter 111 and/or the site controller 103.

Figure 7:
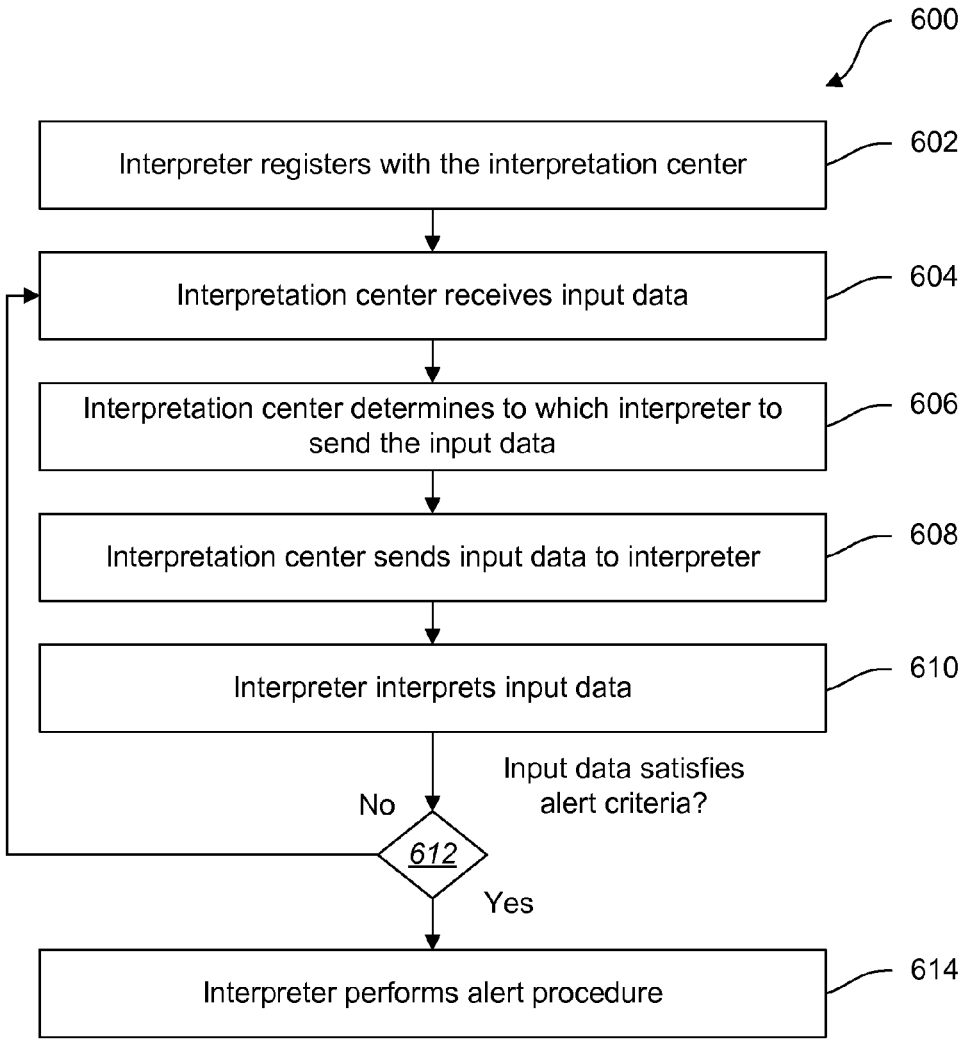
FIG. 7 is a flow diagram of an embodiment of a method for interpreting data from a site.

FIG. 7 is a flow diagram of an embodiment of a method 600 for interpreting data from a site 101. The method 600 may include an interpreter registering 602 with the interpretation center 102. Registering 602 with the interpretation center 102 may include providing contact information, such as an address, telephone number, etc. Registering 602 with the interpretation center 102 may include providing a username and password. Registering 602 with the interpretation center 102 may include providing a network address, email address, and/or other electronic address information. Registering 602 with the interpretation center 102 may include providing payroll information, tax information, and/or other business information.

The interpretation center 102 may receive 604 input data 124. The interpretation center 102 may receive 604 input data 124 directly and/or indirectly from an input device 106. For example, the input device 106 may send the input data 124 indirectly to the interpretation center 102 by sending the input data 124 to a site controller 103 and the site controller 103 may send 410 the input data 124 to the interpretation center 102.

The interpretation center 102 may determine 606 to which interpreter 111 to send 608 the input data 124. The interpretation center 102 may consider interpreter information 354 to determine 606 to which interpreter 111 to send 608 the input data 124. For example, the interpretation center 102 may consider the interpreter's experience, background, past assignments, service reviews, and/or other interpreter information 354 in determining 606 to which interpreter 111 to send 608 the input data 124.

The interpretation center 102 may send 608 input data 124 to the interpreter 111. The interpretation center 102 may consider the interpreter information 354 to determine which method to use to send 608 the input data 124. For example, the interpretation center 102 may send 608 input data 124 to the interpreter 111 via the Internet, email, cellular technologies, wireless, etc. In other embodiments, the interpretation center 102 may notify the interpreter 111 that input data 124 has been received and needs to be interpreted. In further embodiments, the input data 124 may be sent only to interpreters 111 that are currently available to receive input data 124. In other embodiments, the input data 124 may be sent to multiple interpreters 111 until the input data 124 has been adequately interpreted. The input data 124 may be sent to multiple interpreters 111 until a predetermined number, percentage, and/or some other criteria of determinations is satisfied. For example, the alert criteria 350 may specify that a predetermined percentage of determinations must be made before the alert criteria 350 is satisfied, such that when, for example, 80% of the received determinations indicate a certain response, the alert criteria 350 may be satisfied.

The interpreter 111 may interpret 610 the input data 124. Interpreting 610 the input data 124 may include determining whether the input data 124 satisfies predetermined criteria. For example, interpreting 610 the input data 124 may include reviewing the input data 124 in preparation for determining 612 whether the input data 124 satisfies the alert criteria 350. Interpreting 610 the input data 124 generally includes steps that are not typically performed well and/or inexpensively by a computer or other machine.

The interpreter 111 may determine 612 whether the input data 124 satisfies the alert criteria 350. Determining 612 whether the input data 124 satisfies the alert criteria 350 may include comparing the input data 124 with the alert criteria 350 to determine whether the alert criteria 350 are satisfied. For example, the interpreter 111 may look at a picture and/or video taken by a monitoring device 332 to determine whether the input data 124 satisfies the alert criteria 350. In some embodiments, if it is determined that the alert criteria 350 is satisfied, the determination indicating that the alert criteria 350 was satisfied may be stored. For example, the determination indicating that the alert criteria 350 was satisfied may be stored in the interpretation center database 121.

If the interpreter 111 determines 612 that the input data 124 satisfies the alert criteria, the interpreter 111 may perform 614 the alert procedure 352. Performing 614 the alert procedure 352 may include contacting the site 101, using site devices 304 to alert users at the site 101, and/or other alert procedures 352. In some embodiments, the alert procedure 352 may be performed 614 by the interpreter 111 and/or the site controller 103.

For example, if the input data 124 was relating to a smoke alarm, and the interpreter 111 determines 612 that there is smoke in a photograph, the interpretation center 102 may communicate to the site 101, the fire department, and/or a third party service that a fire has been detected. The interpretation center 102 may also communicate with a site controller 103, in response to the alert procedure 352. For example, if the input data 124 indicates that there is a fire at the site 101, the interpretation center 102 may instruct the site controller 103 to turn on lights at the site 101, turn off all ventilation systems, send an audio announcement over audio enabled site devices 304, turn anti-fire systems (i.e. sprinklers, etc.) on, and/or other alert procedures 352.

Figure 8:
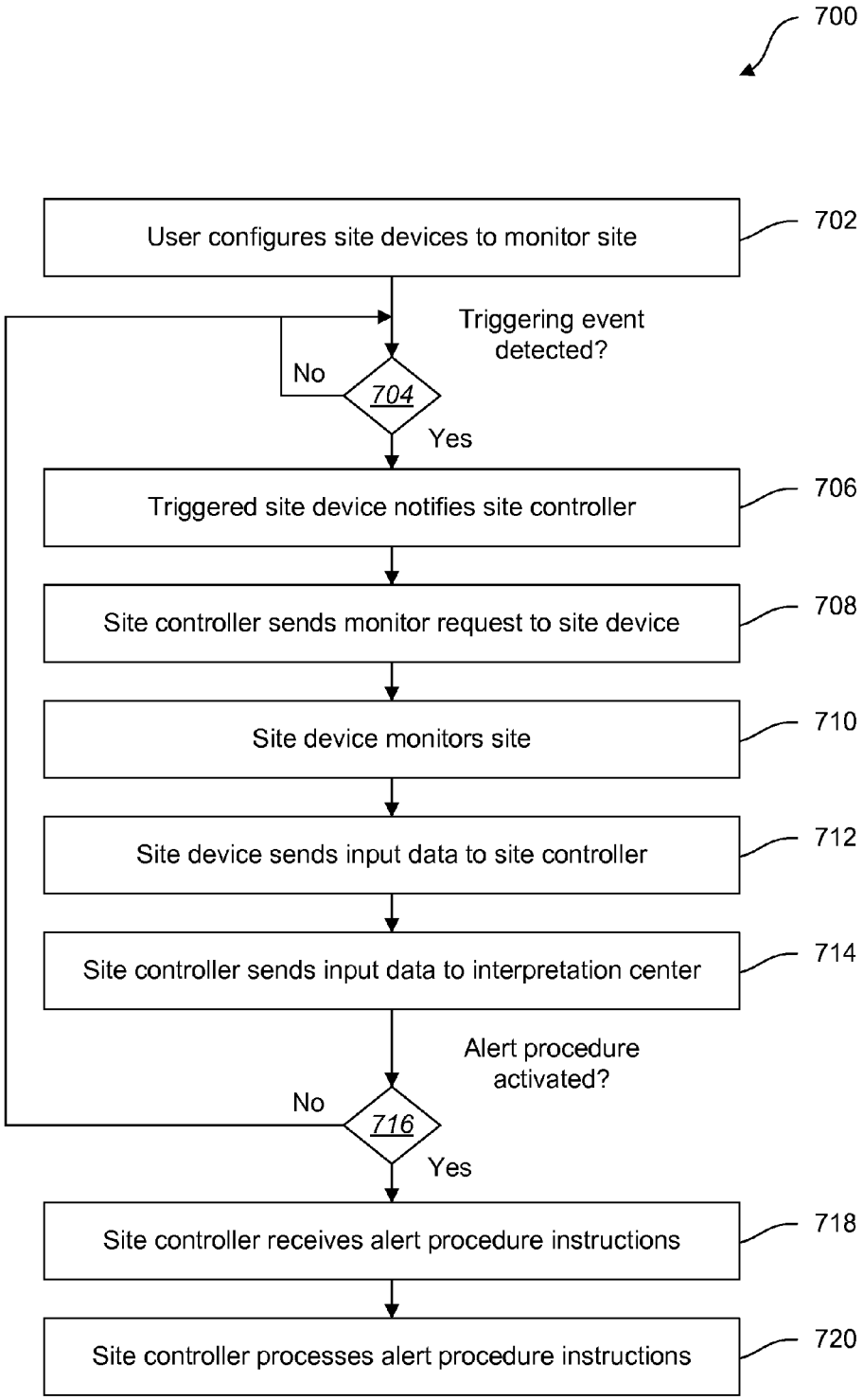
FIG. 8 is a flow diagram of an embodiment of a method for interpreting data from a site.

FIG. 8 is a flow diagram of an embodiment of a method 700 for interpreting data from a site 101. The method 700 may include a user configuring 702 the input devices 106 to monitor the site 101. Configuring 702 the input devices 106 may include determining where to locate the input devices 106 in a site. Configuring 702 the input devices 106 may include connecting the input devices 106 indirectly to the interpretation center 102 through a site controller 103. Configuring 702 the input devices 106 may include storing the triggering events 348, alert criteria 350, and/or alert procedures 352 on the input devices 106 and/or the site controller 103. Configuring 702 the input devices 106 may include storing the site information 356, site device information 358, and/or any other information in the interpretation center database 321.

It may be determined 704 whether a triggering event 348 was detected. For example, a detection device 330 may detect 406 a triggering event 348 and may send input data 124 relating to the detection 406 to the site controller 103. The site controller 103 may determine 704 that the received input data 124 indicates that a triggering event 348 was detected 406.

For example, a site device 304 may be a detection device 330. The detection device 330 may be a water sensor in a basement. The triggering event 348 may be if the water sensor detects water above a certain level in the basement.

The site controller 103 may be notified 706 of the triggering event 348. In the present embodiment, the site controller 103 may be notified 706 of the triggering event 348 by the input device 106 that detected the triggering event 348. Notifying 706 of the triggering event 348 may include sending the input data 124.

A monitoring request may be sent 708 to an input device 106. In the present embodiment, the site controller 103 may send 708 the monitoring request to an input device 106. A monitoring request may include requesting that an input device 106 begin monitoring a portion of the site 101.

An input device 106 may monitor 710 the site 101. In the present embodiment, the input device 106 that received a monitor request may monitor 710 the site 101. Monitoring 710 the site 101 may include recording audio and/or video data, taking still pictures, recording temperature data, recording humidity data, and/or other monitoring processes. Monitoring 710 the site 101 may include storing input data 124 relating to monitoring 710 the site 101.

The input data 124 may be sent. In the present embodiment, the input data 124 is sent 712 by the input device 106 to the site controller 103. The site controller 103 may send 714 the input data 124 to the interpretation center 102.

It may be determined 716 whether an alert procedure 352 was activated. In the present embodiment, the site controller 103 may determine 716 whether an alert procedure 352 was activated. Determining 716 whether an alert procedure 352 was activated may include reviewing data received from the interpretation center 102 to determine 716 whether an alert procedure 352 was activated.

Alert procedures 352 may be received 718. In the present embodiment, the site controller 103 may receive 718 an alert procedure 352. Receiving 718 alert procedures 352 may include receiving instructions from the interpretation center 102 regarding an activated alert procedure 352.

The alert procedures 352 may be processed 720. In the present embodiment, the site controller 103 may process 720 the alert procedures 352. Processing 720 the alert procedures 352 may include turning on lights at the site 101, turning off all ventilation systems, sending an audio announcement over audio enabled site devices 304, turning anti-fire systems (i.e. sprinklers, etc.) on, and/or performing other alert procedures 352.

Figure 9:
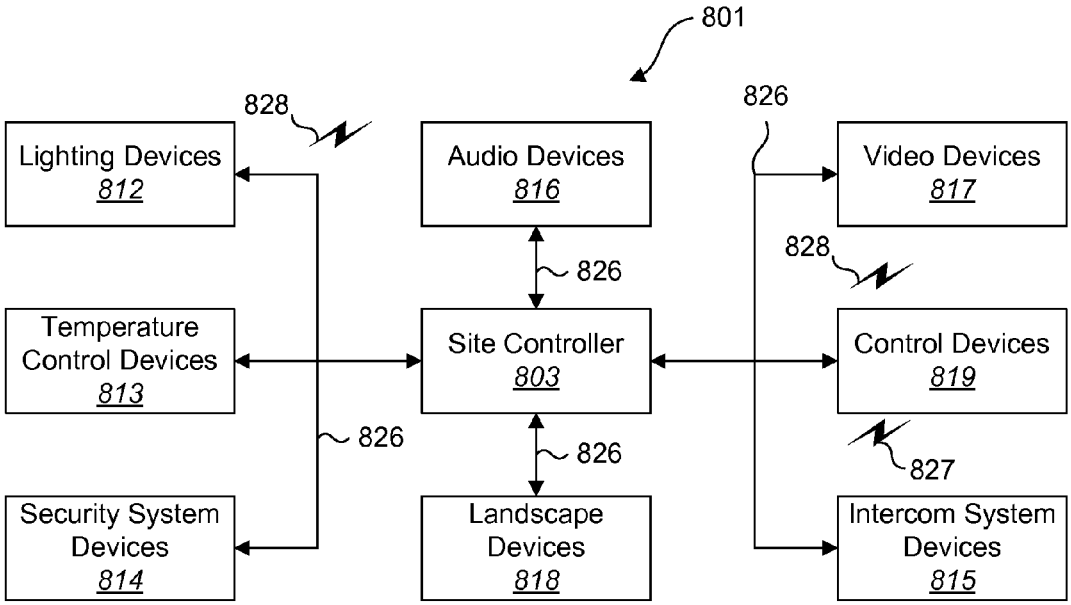
FIG. 9 is a block diagram illustrating an embodiment of a site in which the present systems and methods may be implemented.

FIG. 9 is a block diagram illustrating an embodiment of a site 801 in which the present systems and methods may be implemented. The site 801, in the present embodiment, includes a site controller 803 and other site devices 304. The site controller 803 may be in electronic communication with the site devices 304. A site 801 may include multiple site controllers 103, but typically requires that one of the site controllers 103 is designated as the primary site controller 803.

The site controller 803 may be connected to the site devices 304 via wireless or wired connections. In the present embodiment, the site controller 803 may be connected to the site devices via an Ethernet connection 826, a WiFi connection 827, a ZigBee connection 828, or a combination of the three. The site controller 803 may be capable of communicating via these network connections, i.e. Ethernet, WiFi, or ZigBee connections 826, 827, 828 or other connections.

The site devices 304, in the present embodiment, may include lighting devices 812, temperature control devices 813, security system devices 814, intercom system devices 815, audio devices 816, video devices 817, landscape devices 818, and control devices 819. Lighting devices 812 may include light switches, dimmers, window blinds, etc. Temperature control devices 813 may include thermostats, fans, fireplaces, and the like. Security system devices 814 may include security cameras, motion detectors, door sensors, window sensors, gates, or other security devices. Intercom system devices 815 may include intercom microphones, intercom related video devices, and other devices typically associated with an intercom system. Audio devices 816 may include AM/FM radio receivers, XM radio receivers, CD players, MP3 players, cassette tape players, and other site devices 304 capable of producing an audio signal. Video devices 817 may include televisions, monitors, projectors, and other site devices 304 capable of producing a video signal. Landscape devices 818 may include sprinkler system devices, drip system devices, and other landscape related devices. The control devices 819 may include touch screens, keypads, and remote controls. For example, control devices 819 may include site remote controls, LCD keypads, mini touch screens, or other control devices 819 capable of controlling a site controller 103.

Figure 10:
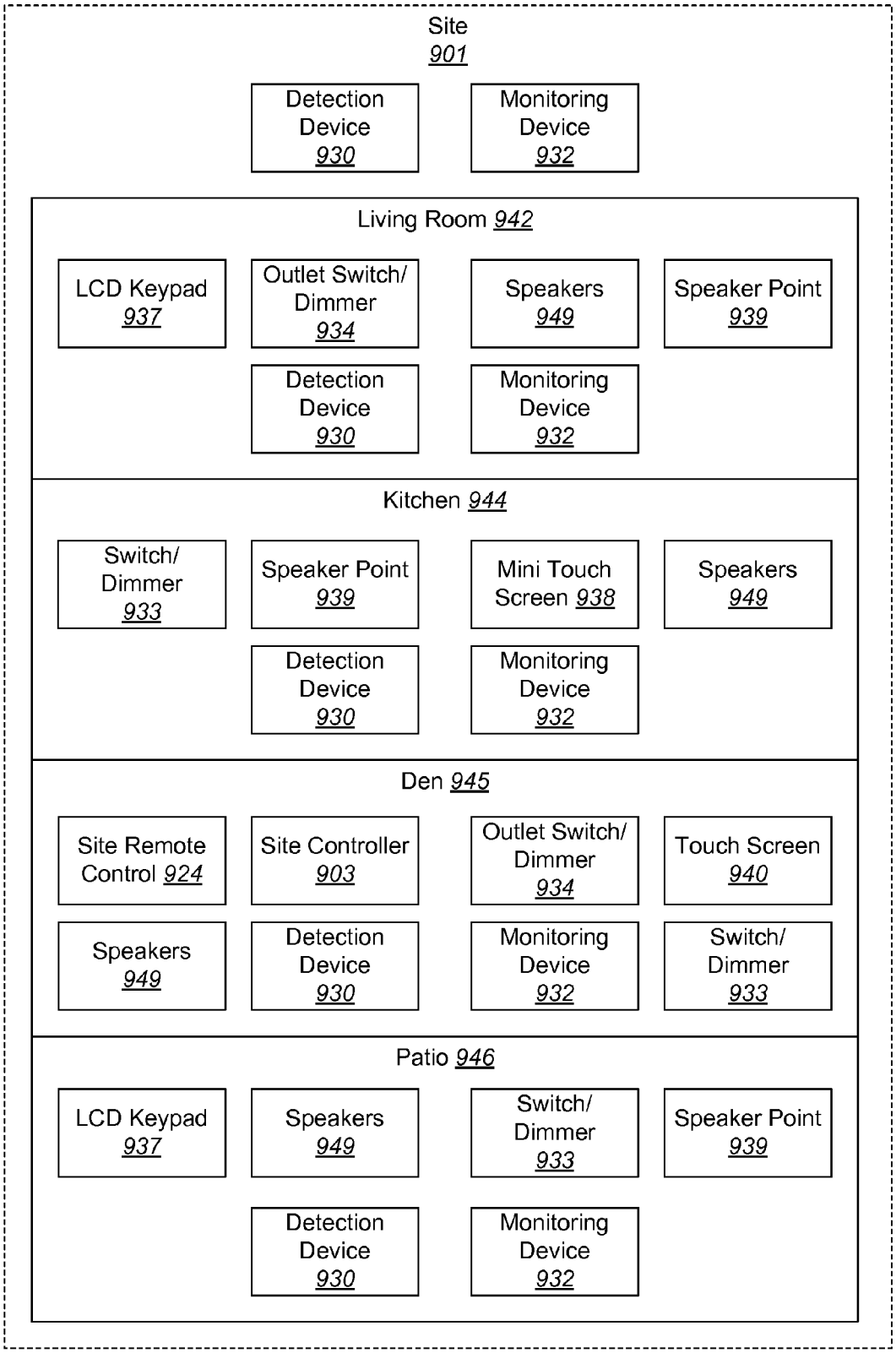
FIG. 10 is a block diagram illustrating an exemplary home automation site in which the present systems and methods may be implemented.

FIG. 10 is a block diagram illustrating an exemplary home automation site 901 in which the present systems and methods may be implemented. The home automation site 901 may include various areas, such as a living room 942, kitchen 944, den 945, and a patio 946. Though the present embodiment illustrates a home automation site 901, other sites 101 may also implement the present systems and methods. For example, the present systems and methods may be implemented in an office building, warehouse, or other site 101. A site 101 may not be limited to a particular building or space. Rather, a site 101 may include a site controller 103 and various site devices 304 in electronic communication with the site controller 103. A home, for example, may include more than one site 101. In some embodiments, multiple site controllers 103 may be used within the same site, though one site controller 103 is typically designated as the primary site controller 903.

Additional site devices 304, other than the site devices 304 shown in FIG. 10, such as intercom system devices 815, temperature control devices 813, etc., may also be used in the present embodiment of a site 901. However, for ease of presentation, only lighting devices 812, security system devices 814, audio devices 816, and control devices 819 are shown in FIG. 10. In the present embodiment, the security system devices 814 may include input devices 106. The input devices 106 may include detection devices 930 and/or monitoring devices 932. Other security system devices 814 may also be used. In the present embodiment, the audio devices 816 include speakers 949 and speaker points 939. Other audio devices 816 and video devices 817 may be used in the present systems and methods, such as CD players, DVD players, Televisions, amplifiers, tuners, MP3 players, digital video recorders, satellite boxes, cable boxes, video game systems, and the like. In the present embodiment, control devices 819 may include site remote controls 924, LCD keypads 937, mini touch screens 938, or other control devices 819. In the present embodiment, the lighting devices 812 may include switch/dimmers 933 and outlet switch/dimmers 934. Other lighting devices 812 and landscape devices 818 may also be used with the present systems and methods.

The site controller 903, in the present embodiment of a site 901, may be located in the den 945. The site controller 903 may be in electronic communication with various site devices 304 over the site network 108. In the present embodiment, some site devices 304, such as audio switches, amplifiers, and tuners may be connected to the site controller 903 via Ethernet connections 826. Site remote controls 924 may be connected to the site controller 903 via ZigBee connections 828. Switch/dimmers 933, outlet switch/dimmers 934, multiple button keypads (not shown), and LCD keypads 937 may be connected to the site controller 903 via Ethernet connections 826 and ZigBee connections 828. Mini touch screens 938 and contact relay extenders 935 may be connected to the site controller 903 via an Ethernet connection 826, a ZigBee connection 828, and a WiFi connection 827. Speaker points 939 may be connected to the site controller 903 via an Ethernet connection 826 and a WiFi connection 827. Touch screens 940 may be connected to the site controller 903 via a ZigBee connection 828 and a WiFi connection 827. The detection devices 930 and/or monitoring devices 932 may be connected to the site controller 903 via a contact relay extender, an Ethernet connection 826, a ZigBee connection 828, and/or a WiFi connection 827.

In the present embodiment, the den 945 may include the site controller 903, a switch/dimmer 933, an outlet switch/dimmer 934, and speakers 949. The speakers 949 in the den 945 may be connected directly to the site controller 903. A site remote control 924 and a touch screen 940 may also be located in the den 945.

In the present embodiment, speakers 949 that are not directly connected to the site controller 903, such as the speakers 949 in the living room 942 and kitchen 944 and the speakers 949 on the patio 946, may be connected to one of the speaker points 939. The speaker points 939 may allow the speakers 949 not directly connected to the site controller 903 to be controlled by the site controller 903. For example, the site controller 903 may transmit audio signals to the speakers 949 via the speaker points 939. The audio signals, in the present embodiment, may be transmitted to the speaker points 939 over an Ethernet connection 826 or a WiFi connection 827. However, any connection capable of the bandwidth necessary to transmit audio signals may be used. Similar connections may be used for transmitting video signals over a site 901.

The site remote control 924 and touch screen 940 in the den 945, the LCD keypads 937 located in the living room 942 and on the patio 946, and the mini touch screen 938 located in the kitchen 944 may be used to control all of the site devices 304 in the site 901 that are connected to the site controller 903. For example, the LCD keypad 937 in the living room 942 may control the site controller 903 in the den 945 to play music over the speakers 949 in the living room 942 via the speaker point 939 in the living room 942. The LCD keypad 937 in the living room 942 may also, for example, control the site controller 903 in the den 945 to play music over all speakers 949 in the site 901 via their respective speaker points 939 or a direct connection to the site controller 903.

Typically devices like the window blinds, fireplaces, or sprinkler systems may not be capable of communication using an Ethernet, WiFi, or ZigBee connection 826, 827, 828. In order to control such devices, the contacts, relays, or other connections that control their function may be connected to a site device 304 that is capable of communication with a site controller 903.

Figure 11:
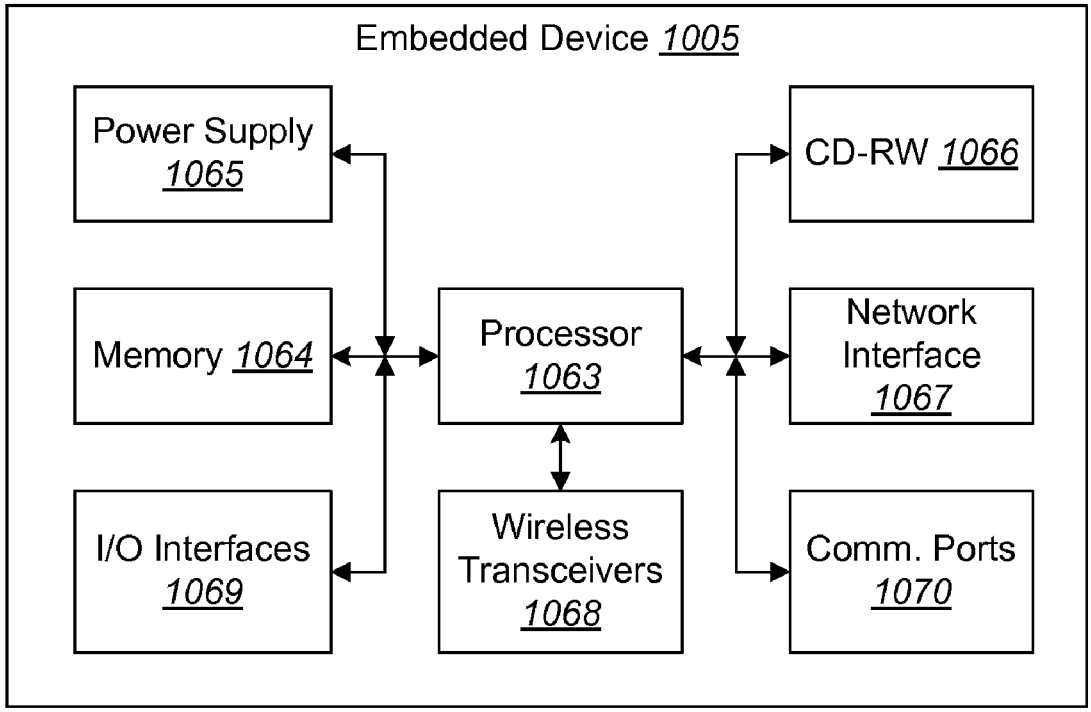
FIG. 11 is a block diagram illustrating various hardware components that may be used in an embodiment of an embedded device that may be found in the site.

FIG. 11 is a block diagram illustrating various hardware components that may be used in an embodiment of an embedded device 1005 that may be found in the site 101. The site controller 103, input devices 106, site devices 304, and control devices 819 may be embedded devices 1005.

The embedded device 1005 may include a processor 1063 that is in electronic communication with memory 1064. The memory 1064 may include volatile and/or non-volatile memory. The embedded device 1005 may include a power supply 1065. The embedded device 1005 may include a CD-RW drive 1066. In other embodiments, the CD-RW drive 1066 may not be a writeable drive, but may only be a CD-ROM drive. In still other embodiments, the CD-RW drive 1066 may be a DVD-RW or a DVD-ROM drive. The CD-RW drive 1066 may also be a Blu-ray disk or a HD DVD drive. The embedded device 1005 may be capable of using the CD-RW drive 1066 to rip audio or video data from CDs and DVDs.

The embedded device 1005 may include a network interface 1067 that allows the embedded device 1005 to connect using wired connections, such as Ethernet connections 826. The network interface 1067 may use various protocols to enable the embedded device 1005 to interface with any wired network. The embedded device 1005 may include wireless transceivers 1068. In the present embodiment, the embedded device 1005 may include a WiFi transceiver and a ZigBee transceiver. The embedded device 1005 may include any type of wireless transceiver 1068. For example, the wireless transceiver 1068 may allow the embedded device 1005 to transmit and receive data using any wireless protocol, such as WiFi, ZigBee, Bluetooth, Ultra Wideband, Wimax, and/or cellular protocols, such as GSM or EVDO.

The embedded device 1005 may include I/O interfaces 1069. For example, the I/O interfaces 1069 may include inputs and/or outputs such as buttons, selection dials, serial ports, contact ports, relay ports, IR windows, IR ports, video sense loop ports, audio ports, and video ports. The embedded device 1005 may include communication ports 1070. The communication ports 1070 may include USB ports, firewire ports, or other ports for communicating with other devices.

Some site controllers 103 and site devices 304 may not include all of the illustrated components. Other site controllers 103 and site devices 304 may include additional components. For example, many site devices 304 may not include a CD-RW drive 1066.

Figure 12:
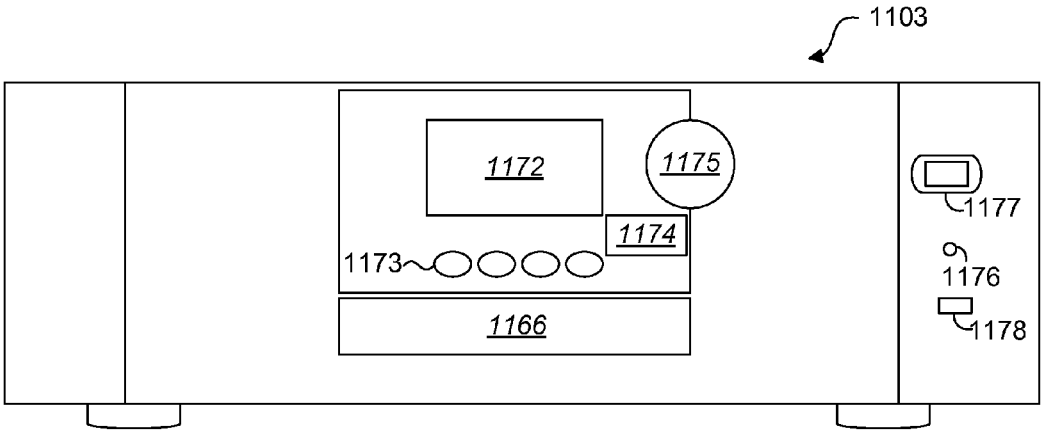
FIG. 12 is a front view of a block diagram illustrating the various features available on an exemplary site controller.

FIG. 12 is a front view of a block diagram illustrating the various features available on an exemplary site controller 1103. Specifically, FIG. 12 shows the front of an exemplary site controller 1103.

The site controller 1103 may include a display area 1172. The display area 1172 in the present embodiment may be used to display settings, playlist sections, title sections, media information, receiver status, and system menus. The site controller 1103 may also include various buttons 1173 for selecting options displayed in the display area 1172.

The site controller 1103 may also include an IR in window 1174. The IR in window 1174 may be used to receive IR codes from the site remote control 924 or from any other device capable of sending IR signals, including other remote controls (not shown) used to control devices that are not capable of communication with the site controller 1103. The site controller 1103 may include a selection dial 1175. The selection dial 1175 may be used to scroll through menus and media lists displayed in the display area 1172.

In the present embodiment, the site controller 1103 may include a reset button 1176. The reset button 1176 may be used to refresh the site controller software 122. The site controller 1103 may also include a WiFi antenna 1177. The WiFi antenna 1177 may be used with an extender (not shown) to improve reception of wireless signals. A ZigBee antenna (not shown) may also be used to extend the range of a wireless transceiver 1068 using a ZigBee connection 828.

The site controller 1103 may also include a CD-RW drive 1166. As discussed above, the CD-RW drive 1166 may be replaced with any drive that is capable of playing CD or DVD related media. The CD-RW drive 1166 may be used to import CD or DVD data into the memory 1064 of the site controller 1103. The site controller 1103 may also include a USB port 1178. The USB port 1178 may be used to import data from USB enabled devices.

Figure 13:
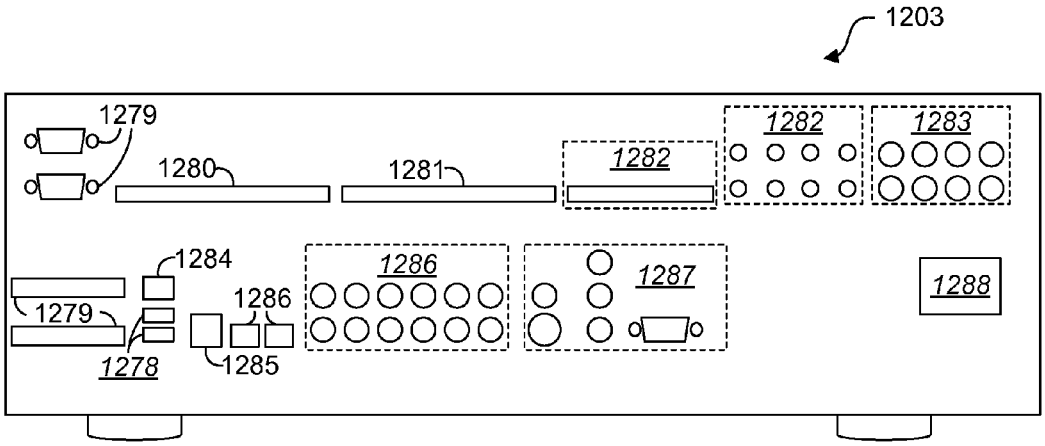
FIG. 13 is a rear view of a block diagram illustrating the various features available on an exemplary site controller.

FIG. 13 is a rear view of a block diagram illustrating the various features available on an exemplary site controller 1203. Specifically, FIG. 13 shows the back of an exemplary site controller 1203. Most connectors and ports are typically found on the back of the site controller 1203 leaving the front more aesthetically pleasing. However, the location of the various connectors and ports is typically not functionally important.

The site controller 1203 may include serial ports 1279. The serial ports 1279 may include standard serial ports and configurable serial ports. The standard serial ports may be used for RS-232 or other I/O devices, which include hardware flow control. In the present embodiment, the site controller 1203 may include two standard serial ports. The configurable serial ports may be used for RS-232, RS-422, or RS-485 devices or for other serial I/O devices. In the present embodiment, the site controller 1203 may include two configurable serial ports.

The site controller 1203 may include contact ports 1280. The contact ports 1280 may include a pluggable terminal block connector that may be used for dry contact closure, or logic input connections, such as door switches or motion sensors. In the present embodiment, the site controller 1203 may include six contact ports 1280. The site controller 1203 may include relay ports 1281. The relay ports 1281 may include a pluggable terminal block connector that may be used for normally closed or normally opened switchable connections, such as blinds, fireplace, or projector screens. In the present embodiment, the site controller 1203 may include six relay ports 1281.

The site controller 1203 may include IR ports 1282. The IR ports 1282 may include IR in ports and IR out ports. The IR in ports may include a pluggable terminal block connector that may be used for handheld IR devices, such as device specific remote controls (not shown). In the present embodiment, the site controller 1203 may include four IR in ports. The IR out ports may include 3.5 mm earphone jacks. The IR out ports may be used for IR sticky emitters that can be placed over IR readers on media players, TVs, or other targets to transmit an IR signal from site controller 1203 to the target. In the present embodiment, the site controller 1203 may include eight IR out ports. The site controller 1203 may include video sense loop in/out ports 1283. The video sense loop in/out ports 1283 may be composite ports for video sources, such as DVD players or VCRs, which allow the site controller 1203 to detect the On/Off status of devices that use the same IR code for both on and off commands. The site controller 1203, in the present embodiment, may include four pairs of video sense loop in/out ports 1283 (four in and four out).

The site controller 1203 may include an Ethernet connector 1284 for establishing an Ethernet connection 826 with the site devices 304 in a site 101. The Ethernet connector 1284 may be connected to the network interface 1067 on the site controller 1203. The Ethernet connector 1284 may be an RJ-45 for a 10/100 BaseT Ethernet connector. In the present embodiment, the site controller 1203 may include an additional USB port 1278 on the back of the site controller 1203. A modem port 1285 may be included with the site controller 1203. The modem port 1285 may be an RJ-11 port for a modem to support caller ID or a voice menu system.

The site controller 1203 may also include audio in/out ports 1286. The audio in ports may be RCA jacks for stereo channel input for stereo analog sources. In the present embodiment, the site controller may include three audio in ports. The audio out ports may be RCA jacks for stereo channel output. In the present embodiment, the site controller 1203 may include three audio out ports. The audio in/out ports 1286 may include digital audio in/out ports. The digital audio in/out ports may be designed for a Toslink™ optical cable for digital audio in/out, like MP3 players, CD players, DVD players, etc.

The site controller 1203 may include various video ports 1287. The video ports 1287 may be in/out ports and may include composite video ports, S-Video ports, component video ports, and/or VGA ports. The video ports 1287 may be used to display navigation menus on a monitor or TV. In the present embodiment, the video ports 1287 include a composite video out port, an S-Video out port, a component video out port, and a VGA out port. A power plug port 1288 may be included in the site controller 1203.

The site controller 1203 is different than a personal computer for a number of reasons. The site controller 1203 is an embedded system that is specialized for the functions and purposes set forth herein. The site controller 1203 generally does not include a keyboard or mouse for standard operation. Unlike a personal computer, the site controller 1203 may not contain an expandable motherboard. For example, the site controller 1203 may not include expandable memory slots or expandable ports, such as a PCI, AGP, or PCI Express card slot. Unlike a personal computer, the site controller 1203 may also not have an exclusive computer monitor. For example, typically a personal computer may include a relatively large monitor or display that is primarily for viewing an operating system user interface and executed programs. The site controller 1203 may merely use a television or monitor for brief periods of time, although the television or monitor may primarily be used for viewing television programming, DVDs, etc. In another example, the site controller 1203 may be used without a separate monitor; the site controller 1203 may use the display area 1272. Typically, a personal computer with such a small display area would be incapable of the multiple interfaces and ports that may be found on a site controller 1203. The site controller 1203 may also not have the capability to install and run third party software, such as word processing software. The site controller 1203 typically does not allow a user to install and run third party software on the controller 1203. Unlike a personal computer, a typical user generally could not install a different operating system on the site controller 1203.

Figure 14:
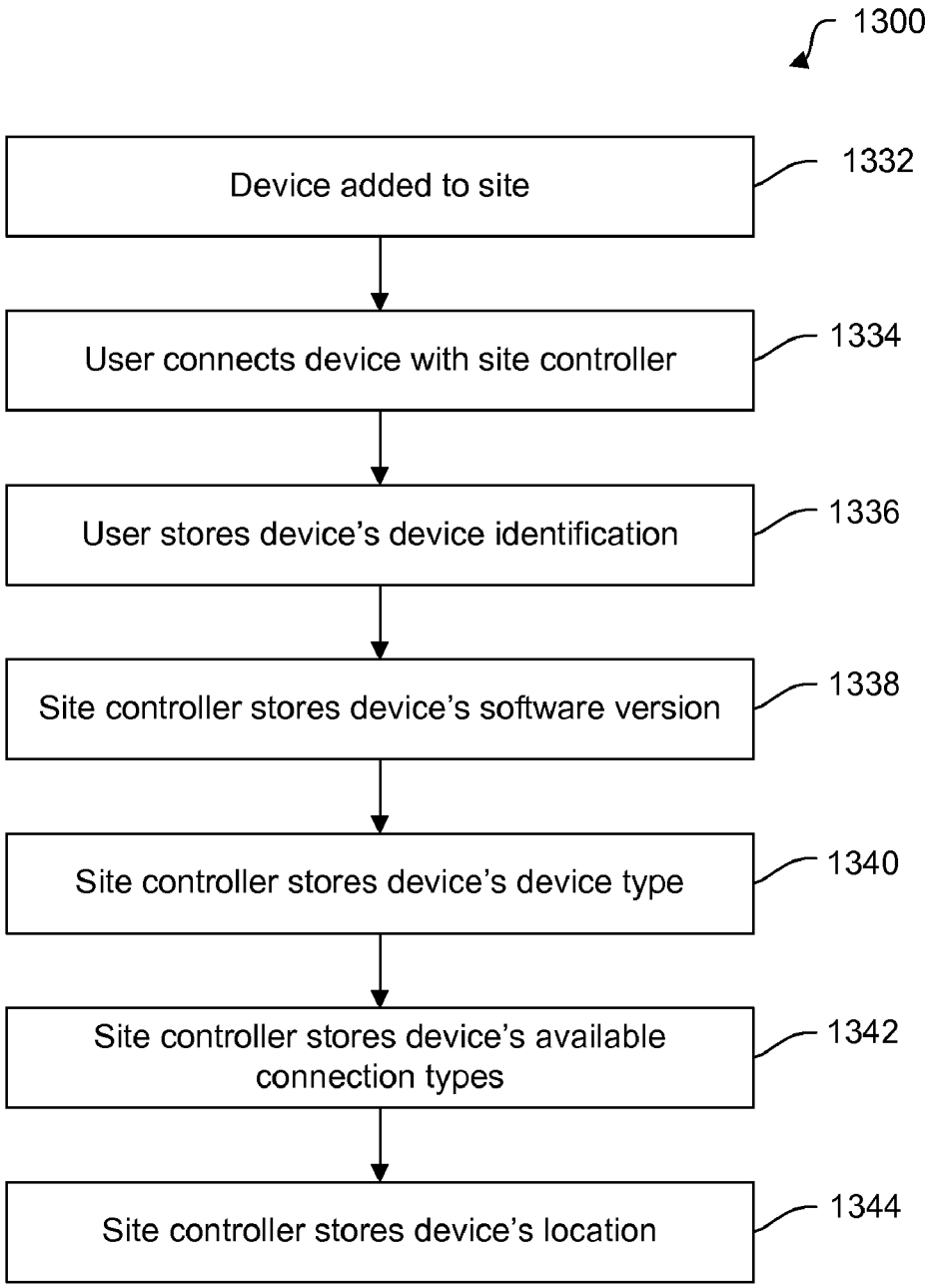
FIG. 14 is a flow diagram of an embodiment of a method for registering site devices at a site.

FIG. 14 is a flow diagram of an embodiment of a method 1300 for registering site devices 304 at a site 101. A site device 304 may be added 1332 to the site 101. For example, a switch/dimmer 933 may be installed in a home or a thermostat may be installed in an office building. In another example, a site remote control 924 or LCD keypad 937 may be installed in a home or office. For site devices 304 that are capable of communication over an Ethernet connection 826, adding 1332 a device to a site 101 may include connecting the device over an Ethernet connection 826. The user may connect 1334 the device with the site controller 103. Connecting 1334 the device with the site controller 103 may include turning on the device to enable wired or wireless communication with the site controller 103.

The user may store 1336 a device identification for the site device 304 on the site controller 103 by accessing the site controller 103. For example, the device identification may be stored in a site database on the site controller 103. The site controller 103 may store 1338 the device functionality of the site device 304. For example, the device functionality may be stored in the device database on the site controller 103. The site controller 103 may store 1340 a device type for the site device 304 on the site controller 103 (e.g., in the device database on the site controller 103). The site controller 103 may store 1342 the connection types available for the site device 304 on the site controller 103. For example, if the site device 304 is capable only of an Ethernet connection 826 and a ZigBee connection 828, this may be stored 1342 on the site controller 103. The site controller 103 may store 1344 the location of the site device 304. For example, the device location may indicate if the site device 304 is located in the living room 942, kitchen 944, den 945, or on the patio 946, etc. The device identification, device type, available connection types (i.e., an Ethernet connection 826, a WiFi connection 827, a ZigBee connection 828, or other connection types), and device location may be stored 1336, 1338, 1340, 1342, 1344 in the device database on the site controller 103.

In another embodiment, the site controller 103 may determine and store the device identification, device type, device functionality, available connection types, or device location without user input. For example, the site controller 103 may attempt to determine the available connection types by pinging the site device 304, the device location by comparing the device's response time to requests, the device type or device functionality by attempting to perform functions typically performed by the various device types, etc.

Information and signals may be represented using any of a variety of different technologies and techniques. For example, data, instructions, commands, information, signals, bits, symbols, and chips that may be referenced throughout the above description may be represented by voltages, currents, electromagnetic waves, magnetic fields or particles, optical fields or particles, or any combination thereof.

The various illustrative logical blocks, modules, circuits, and algorithm steps described in connection with the embodiments disclosed herein may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present invention.

The various illustrative logical blocks, modules, and circuits described in connection with the embodiments disclosed herein may be implemented or performed with a general purpose processor, a digital signal processor (DSP), an application specific integrated circuit (ASIC), a field programmable gate array signal (FPGA) or other programmable logic device, discrete gate or transistor logic, discrete hardware components, or any combination thereof designed to perform the functions described herein. A general purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration.

Functions such as executing, processing, performing, running, determining, notifying, sending, receiving, storing, requesting, and/or other functions may include performing the function using a web service. Web services may include software systems designed to support interoperable machine-to-machine interaction over a computer network, such as the Internet. Web services may include various protocols and standards that may be used to exchange data between applications or systems. For example, the web services may include messaging specifications, security specifications, reliable messaging specifications, transaction specifications, metadata specifications, XML specifications, management specifications, and/or business process specifications. Commonly used specifications like SOAP, WSDL, XML, and/or other specifications may be used.

The steps of a method or algorithm described in connection with the embodiments disclosed herein may be embodied directly in hardware, in a software module executed by a processor, or in a combination of the two. A software module may reside in RAM memory, flash memory, ROM memory, EPROM memory, EEPROM memory, registers, hard disk, a removable disk, a CD-ROM, or any other form of storage medium known in the art. An exemplary storage medium is coupled to the processor such that the processor can read information from, and write information to, the storage medium. In the alternative, the storage medium may be integral to the processor. The processor and the storage medium may reside in an ASIC. The ASIC may reside in a user terminal. In the alternative, the processor and the storage medium may reside as discrete components in a user terminal.

The methods disclosed herein comprise one or more steps or actions for achieving the described method. The method steps and/or actions may be interchanged with one another without departing from the scope of the present invention. In other words, unless a specific order of steps or actions is required for proper operation of the embodiment, the order and/or use of specific steps and/or actions may be modified without departing from the scope of the present invention.

While specific embodiments and applications of the present invention have been illustrated and described, it is to be understood that the invention is not limited to the precise configuration and components disclosed herein. Various modifications, changes, and variations which will be apparent to those skilled in the art may be made in the arrangement, operation, and details of the methods and systems of the present invention disclosed herein without departing from the spirit and scope of the invention.

What is claimed is:

1. A method for interpreting data from a site, comprising:
acquiring input data to be interpreted;
sending the input data to a human interpreter;
sending alert criteria to the human interpreter, wherein the alert criteria comprises a question for the human interpreter to answer to determine whether the alert criteria is satisfied;
receiving a determination that indicates whether the alert criteria was satisfied; and
if the determination indicates that the alert criteria was satisfied, performing an alert procedure.

2. The method of claim 1, wherein the input data is acquired from an input device.

3. The method of claim 1, further comprising providing a visual image to the human interpreter.

4. The method of claim 1, wherein the alert criteria comprises explicit criteria.

5. The method of claim 1, wherein the alert criteria comprises implicit criteria.

6. The method of claim 1, wherein the alert procedure initiates an alert.

7. The method of claim 1, wherein the alert procedure cancels an alert.

8. The method of claim 1, wherein the alert criteria comprises a list.

9. The method of claim 1, further comprising storing the determination that indicates whether the alert criteria was satisfied.

10. The method of claim 1, further comprising determining to which human interpreter to send the input data and the alert criteria.

11. The method of claim 1, further comprising determining whether a triggering event was detected.

12. The method of claim 1, wherein a site controller sends the input data to the human interpreter.

13. The method of claim 2, wherein the alert criteria is sent from the input device to a site controller and then sent from the site controller to the human interpreter.

14. The method of claim 13, further comprising configuring the input device to store one or more triggering events, the alert criteria, and the alert procedure.

15. The method as in claim 14, wherein the input data is sent to multiple human interpreters until a predetermined number of determinations are made.

16. A system that is configured for interpreting data from a site, the system comprising:
a processor;
memory in electronic communication with the processor; and
instructions stored in the memory, the instructions being executable to:
acquire input data;
send the input data to a human interpreter;
send alert criteria to the human interpreter, wherein the alert criteria comprises a question for the human interpreter to answer to determine whether the alert criteria is satisfied;
receive a determination that indicates whether the alert criteria was satisfied; and
if the determination indicates that the alert criteria was satisfied, perform an alert procedure.

17. The system of claim 16, wherein the input data is acquired from an input device.

18. The system of claim 16, wherein the instructions are further executable to provide a visual image to the human interpreter.

19. The system of claim 16, wherein the alert criteria comprises explicit criteria or implicit criteria.

20. The system of claim 16, wherein the alert criteria comprises a list of statements.

21. The system of claim 16, wherein the instructions are further executable to store the determination that indicates whether the alert criteria was satisfied.

22. The system of claim 16, further comprising a site controller that receives the input data from the input device and sends the input data to an interpretation center, wherein the site controller comprises an embedded system that includes built-in audio ports, built-in video ports, and built-in infrared in and out ports and wherein the site controller does not require an external exclusive computer monitor for standard operation.

23. An interpretation center that is configured for interpreting data from a site, wherein the interpretation center is in electronic communication with a plurality of human interpreters, the interpretation center comprising:
a processor;
memory in electronic communication with the processor;
instructions stored in the memory, the instructions being executable to:
register the human interpreters with the interpretation center;
acquire input data that originated from an input device, wherein the input device is in electronic communication with the interpretation center;
send the input data to the human interpreters;
send alert criteria to the human interpreters, wherein the alert criteria comprises a question for the human interpreter to answer to determine whether the alert criteria is satisfied;
receive a determination that indicates whether the alert criteria was satisfied from at least one of the human interpreters; and
if the determination indicates that the alert criteria was satisfied, perform an alert procedure.

24. The interpretation center of claim 23, wherein the instructions are further executable to provide visual images to the human interpreters.

25. The interpretation center of claim 23, wherein the alert criteria comprises explicit criteria.

26. The interpretation center of claim 23, wherein the alert criteria comprises implicit criteria.

27. The interpretation center of claim 23, wherein the alert procedure initiates an alert.

28. The interpretation center of claim 23, wherein the alert procedure cancels an alert.

* * * * *

UNITED STATES PATENT AND TRADEMARK OFFICE

CERTIFICATE OF CORRECTION

PATENT NO. : 8,072,322 B1
APPLICATION NO. : 11/669062
DATED : December 6, 2011
INVENTOR(S) : Michael L. Howard It is certified that error appears in the above-identified patent and that said Letters Patent is hereby corrected as shown below:

In col. 20, line 33 delete "of statements".

Signed and Sealed this
Fifteenth Day of May, 2012

David J. Kappos

David J. Kappos
*Director of the United States Patent and Trademark Office*